United States Patent [19]

Thivans

[11] 3,937,165

[45] Feb. 10, 1976

[54] CONSTRUCTION OF BRIDGE DECKING AND LIKE STRUCTURES

[75] Inventor: Pierre Armand Maurice Thivans, Chevreuse, France

[73] Assignee: Campenon Bernard Europe, Paris, France

[22] Filed: Sept. 20, 1974

[21] Appl. No.: 507,950

[30] Foreign Application Priority Data

Sept. 21, 1973 France ..... 73.33961

[52] U.S. Cl. ..... 14/77

[51] Int. Cl.[2] ..... E01D 19/02

[58] Field of Search ..... 14/77, 7, 1

[56] References Cited

UNITED STATES PATENTS

| | | | |
|---|---|---|---|
| 3,706,125 | 12/1972 | Hopkins | 14/77 X |
| 3,832,748 | 9/1974 | Ogletree | 14/77 X |
| 3,845,515 | 11/1974 | Gelhard | 14/77 |

*Primary Examiner*—Nile C. Byers

*Attorney, Agent, or Firm*—Laurence R. Brown

[57] ABSTRACT

The invention refers to an improvement in the construction of segmental spans such as bridges and similar structures by the method known as "step-by-step" consisting in mounting segments or modules in succession at the end of a cantilever span section already erected. In accordance with this improvement, each module is moved in the decking parallel with its width as far as a stand-by position, then lifted by an arm which is pivoted a quarter of a turn about a vertical post located beside the module and inboard of the span section and resting on it by two beams. The module is next lowered and is in the erection position.

8 Claims, 5 Drawing Figures

CONSTRUCTION OF BRIDGE DECKING AND LIKE STRUCTURES

The invention refers to bridges and like structures such as elevated roadways and tracks having a floor comprising segmental of and supported by pillars or posts and deals more precisely with the construction of the segmental spans of such a bridge or structure by the method known as "step-by-step", consisting in mounting a plurality of prefabricated segments or modules in succession at the end of a cantilever span section already erected.

The segments of a prestressed concrete floor of the segmental span type are prefabricated modules the width or transverse dimension of which is equal to the width of the floor. Although their length is small in comparison with this width they have a considerable weight, of the order of 50 to 100 tons or even more. Putting them in place at the end of a cantilever span section presents a particularly difficult problem.

The present invention provides a solution of this problem.

In accordance with the invention each module is moved parallel with its transverse dimension, preferably by means of a trolley running substantially along the centerline of the cantilever span section already erected, up to a stand-by position next to the end of this section, then the module is raised by means of a crane comprising an arm mounted pivotally about a vertical post resting on this section near its end edge and between one of its lateral side edges and the module in the stand-by position, and this arm is made to pivot by about a quarter of a revolution over the end edge so that the transverse dimension of the module is directed transversely to the floor, the position of the post of the crane being chosen so that it is sufficient then to lower the module for it to come and place itself in the erection position at the end of the cantilever span section.

The crane preferably rests on the cantilever span section, by two beams going out from the foot of the post and extending respectively in the longitudinal and in the transverse direction of the span section, the height of the transverse beam being sufficiently low to enable an end portion of the module located on the trolley and if necessary an end portion of the platform of the trolley itself to project over the said transverse beam.

The description which follows in respect of the attached drawings, given by way of non-restrictive example, will enable the advantages of the invention and the art of achieving it to be clearly understood.

Figure 1:
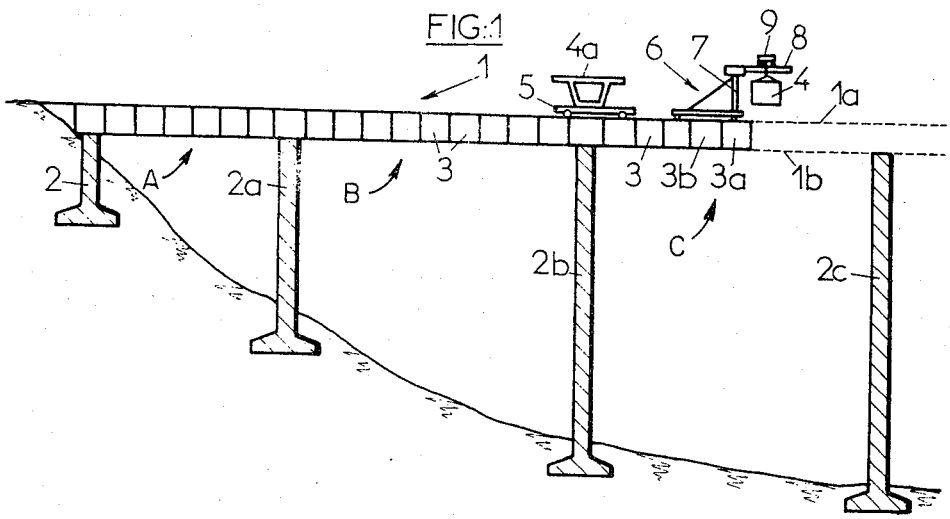
FIG. 1 is a diagrammatic elevation of a bridge in course of construction.
Figure 2:
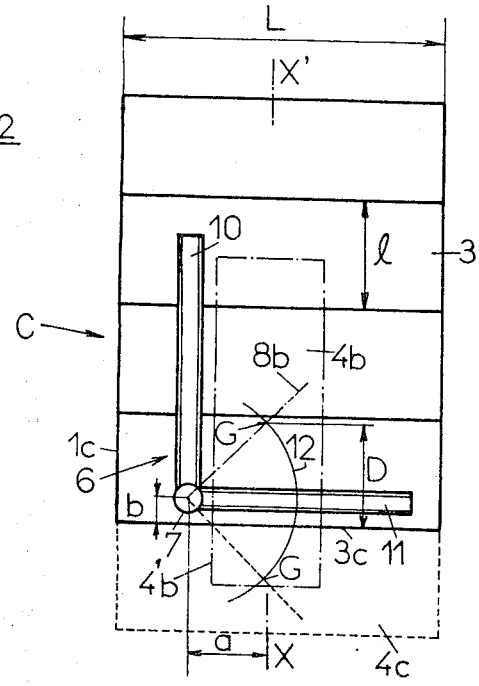
FIG. 2 is a diagrammatic plan on a larger scale, of the end of the cantilever span section in course of erection.

In FIGS. 1 and 2 is seen a section of floor 1 of a bridge in course of construction, comprising a plurality of segmental spans 1*a*, 1*b*, 1*c* resting on pillars 2, 2*a*, 2*b*. The spans are made of segments 3 which are prefabricated modules having a transverse dimension L equal to the width of the decking and length 1 which is much less. The floor is being constructed "step-by-step", that is to say, a module 3*a* has been put in place and fixed provisionally next to the module 3b that was at the time at the end of a cantilever span section 1, and the drawings illustrate the putting in position of another module 4 against the module 3*a*. The module 4 has a considerable weight as has already been indicated, and its putting in position at the end of the cantilever span section which is in an overhang between the pillar 2*b* and the next pillar 2*c* is manifestly a very delicate operation. The dotted lines 1*d* and 1*c* suggest the contour of the span section as it will appear when finished.

FIGS. 1 and 2 illustrate diagrammatically the putting into position of the module 4 by means of a trolley 5 and a crane 6. The trolley 5 moves along the centerline of the floor 1, carrying the module 4 which is laid on the trolley so as to move parallel with its transverse dimension as seen at 4*a* in FIG. 1. It is therefore sufficient to keep free for the passing of the trolley and the module a relatively narrow central strip of the cantilever span section 1*c*, which enables the post 7 of the crane 6 to be located inboard, that is to say, between the trolley and a side edge 1*f* of the cantilever span section 1*c*. At the top of the post 7 is mounted pivotally the arm 8 of the crane which carries a hoist crab 9, and the stability of the crane is ensured by a longitudinal beam 10 and a transverse beam 11 projecting from the foot of the post 7 and resting on the cantilever span section. As may be seen particularly in FIG. 2 the transverse beam 11 is located near the end edge 3*a* of the last segment or module 3*a* put in position, and its height is sufficiently low to enable the module 4 to be brought by means of the trolley 5 up to the stand-by position indicated in dash-dot line at 4*b* in which one end portion 4'*b* of this module is projecting over the beam 11 and extends a good way beyond the end edge 3*c* of the cantilever span section 1*c*.

It can be seen from FIG. 2 that the arm 8 must be made to turn through a right angle in order to bring the arm from the position indicated in dash-dot line at 8*b* in which the arm intersects the vertical through the centre of gravity G of the module 4 in its stand-by position 4*b*, into the position indicated in broken line at 8*c* in which the arm overhangs the centre of gravity G of the module 4 when the latter occupies the erection position (indicated in broken line at 4*c*) in which the module is mounted on the end of the cantilever span section 1*c*. An elementary geometrical construction (which is not drawn in FIG. 2) shows that the position of the post 7 which enables the achievement of this motion is determined by the relationships:

$$a = \tfrac{1}{2}(D+l/2) \text{ and } 6 = \tfrac{1}{2}(D-l/2),$$

in which D designates the distance of the centre of gravity G of the module 4 in the stand-by position 4*b*, from the end edge 3*c* of the cantilever span section 1*c*, *a* designates the distance of the centre of the post 7 from the axis XX' of this section 1, and *b* designates the distance of the centre of the post 7 from the end edge 3*c*. For the post 7 to rest on the cantilever span section 1*c* between the edge 1*f* of the latter and the module 4 in the stand-by position 4*b*, it is necessary that:

$$l/2 + d < D < L - l/2 - d,$$

*d* being the diameter of the post 7.

In order to put the module 4 in erection position, therefore, the trolley 5 is brought up to the vicinity of the end of the cantilever span section 1*c* so that the module arrives in the stand-by position 4*b*. The arm 8 is then pivoted round to the position 8*b* and the crab 9 is brought into the vertical through the centre of gravity G of the module in the position 4*b*. The module is then slung and hooked onto the crab 9 and raised above the trolley 5 by means of a cylinder (not shown) integral with the hoist crab 9, then the arm is pivoted through a right angle in order to bring it into the position 8*c*. In this position, as may be seen in FIG. 1, the module 4 has turned through a right angle with the arm, so that its transverse dimension is now pointing transversely across the cantilever span section 1*c*; moreover it is lying exactly on the vertical through the erection position represented at 4*c* in FIG. 2, so that it is sufficient to lower the module by means of the cylinder for the module to come and lay itself against the end edge 3*c* where the module is fixed by known means not forming any part of the invention.

It should be observed that during the pivoting of the arm 8 the centre of gravity G of the module 4 describes an arc of a circle, indicated at 12 in FIG. 2, which displaces it only a very little from the axis XX′ and to the side opposite to the crane post 7. The loads applied to the overhanging end portion of the cantilever span section during the placing in position of the module 4 are therefore only slightly off-centre and do not introduce a risk of causing excessive torsional stresses.

Figure 3:
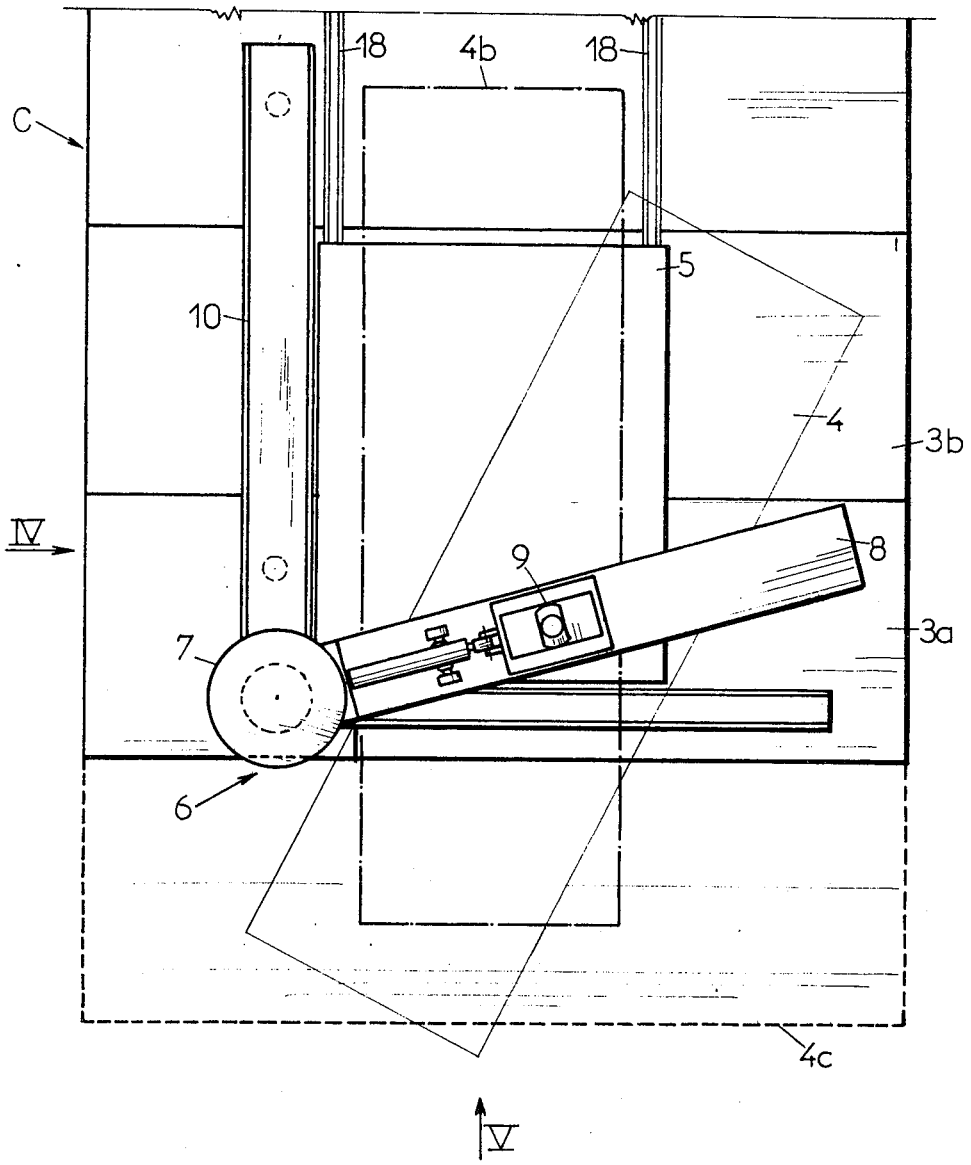
FIG. 3 is a plan view similar to FIG. 2 but on a still larger scale.
Figure 4:
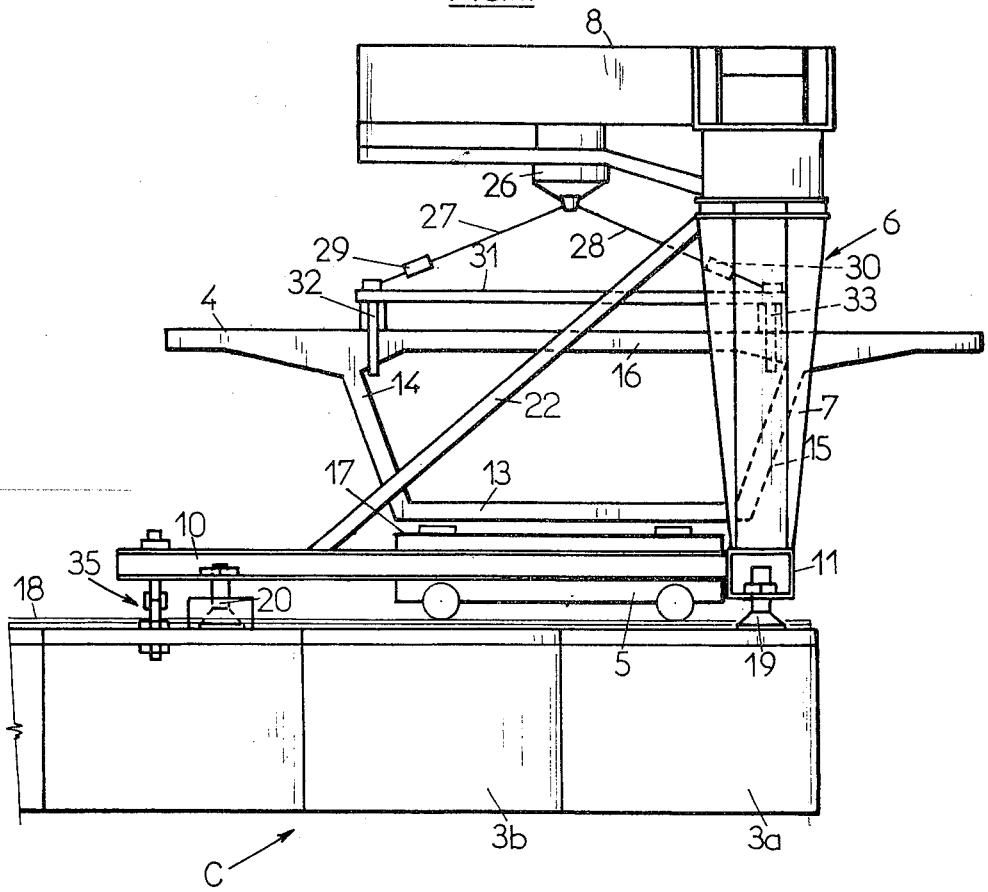
FIG. 4 is a side elevation in the direction of the arrow IV in FIG. 3, showing the arm of the crane in the picking up position.
Figure 5:
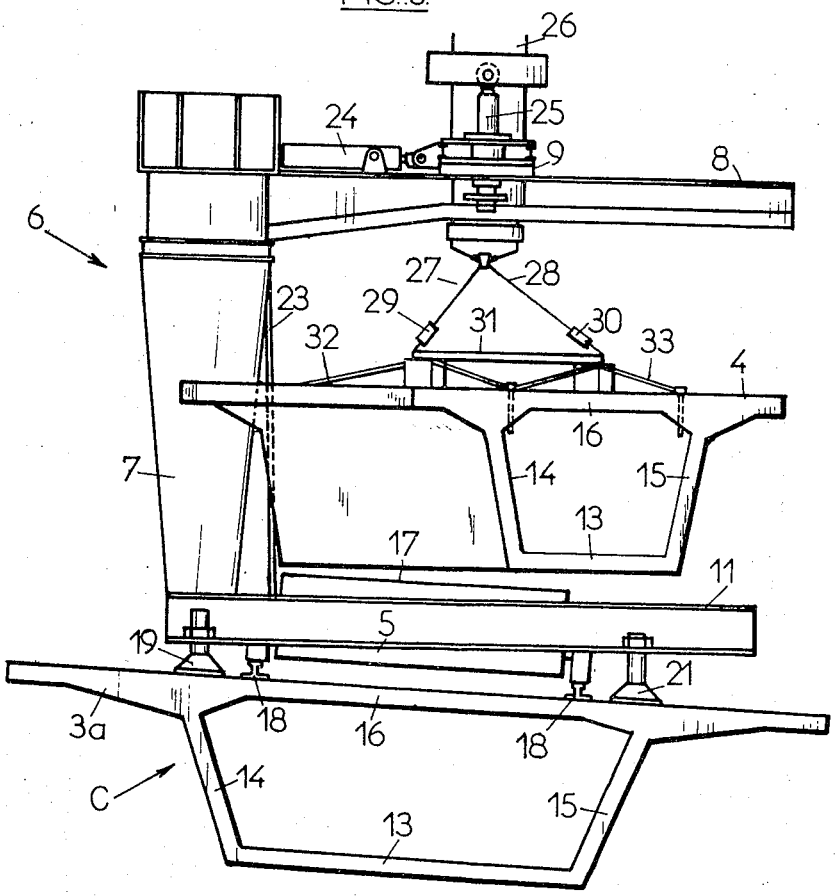
FIG. 5 is an elevation in the direction of the arrow V in FIG. 3, showing the arm in an intermediate position.

FIGS. 3 to 5 show details of execution on a larger scale. The trolley 5, crane 6 and module 4 are represented in FIG. 4 in the positions they occupy when the module has just been raised; they are represented in FIGS. 3 and 5 in an intermediate position during pivoting of the arm 8. In FIGS. 4 and 5 is seen the transverse profile of the modules comprising a bottom slab 13, two webs 14, 15 and a top slab 16 which extends on each side of the webs. During movement along the floor 1 the bottom slab 13 of the module 4 rests on the platform 17 of the trolley 5 which runs on the rails 18.

In the embodiment illustrated the bridge is curved, so that the upper face 16 of the cantilever span section 1*c* is banked as seen in FIG. 5. The crane 6/rests on three supports 19, 20, 21, of adjustable height, similar to screw-jacks, located respectively under the post 7 and under the beams 10 and 11 and enabling the post 7 to be set vertically in spite of the slant of the floor. The heights of the beam 11 and the trolley 5 are such that the platform 17 of the trolley can project over this beam 11 which enables the module 4 to be brought up to the position illustrated in FIG. 4. In other embodiments, however, for example, if the bottom slab 13 were narrower, it would be sufficient that the portion of the top slab 16 outside the web 15 could project over the beam 11 and the latter might be higher.

As may be seen in FIGS. 3 and 5, the width of the trolley is bigger than the length l of the modules, which enables the rails 18 to be separated more and consequently the stresses to be reduced which are imposed on the floor during the movement of the module 4. Two auxiliary stays 22 and 23 contribute to ensuring stabilization of the crane post 7 on the two rightangled beams 10 and 11, whilst reducing distortions and stresses in the structure.

The pivotal mounting of the arm 8 at the top of the post 7 may advantageously call upon an orientation-crown. At 24 is seen a hydraulic cylinder enabling the crab 9 to be moved along the arm 8 and at 25 the hydraulic hoist cylinder on this crab. This cylinder 25 (which is not shown in FIG. 4) lifts an equipment 26 from which extend two rods 27, 28 connected respectively by two small hydraulic cylinders 29, 30 to a spreader 31 to which the module 4 is hooked by means of slings 32, 33. The cylinders 29, 30 enable the tilt of the module 4 to be adjusted during its placing in outboard position at 4*c*, to the tilt of the inboard module or segment 3*a*.

After fixing the module 4 in the erection position 4*c* rails extending the track 18 are laid on it and the crane 6 is shifted so that the crane rests on this module 4 in the position 4*c* the position that the crane previously occupied on the module 3*a*. This shift may be carried out by any suitable means. For example, the beams 10, 11 are moved along on slides laid on the floor or run on rollers or wheels. This shift can also be carried out by means of the trolley 5.

When the crane 6 has reached the chosed location its position is adjusted by means of the jacks 19, 20, 21 and the beam 10 is fixed to the cantilever span section by means of an articulated anchoring-device one element of which is illustrated diagrammatically at 35 in FIG. 4. One then proceeds with the placing in position of the next module.

The prefabricated modules are advantageously stored on the floor. They are loaded onto the trolley by a conventional hoist apparatus which is not shown.

I claim:

1. In a "step-by-step" method for the construction of a segmental span structure, in which a plurality of modules having a transverse dimension equal to the width of the span structure and a length substantially less than said transverse dimension, are mounted in succession at the end of a cantilever span section disposed between successive supporting pillars, the improvement comprising the steps of (a) displacing a module along the cantilever span section with said transverse dimension of the module parallel to said span section, up to a stand-by position adjacent an end edge of the cantilever span section; (b) lifting the module; (c) pivoting the module by a quarter of a turn over said end edge about a substantially vertical axis located between a side edge of the cantilever span section and the module in said stand-by position, to bring the module in outboard position with the transverse dimension of the module parallel to said end edge; and (d) lowering the module from said outboard position to an erection position engaging said end edge.

2. A method as claimed in claim 1, wherein the module is displaced along the centerline of the cantilever span section.

3. A method as claimed in claim 1, wherein a portion of the module in said stand-by position projects beyond said end edge of the cantilever span section.

4. In a system for erecting a segmental span structure, in which a plurality of modules having a transverse dimension equal to the width of the span structure and a length substantially less than said transverse dimension, are mounted in succession at the end of a cantilever span section disposed between successive supporting pillars, the improvement comprising (a) means for displacing a module along the cantilever span section with said transverse dimension substantially parallel to said span section, up to a stand-by position adjacent an end edge of the cantilever span section; and (b) crane means for bringing the module to an erection position in which the module engages said end edge with said transverse dimension parallel thereto, the crane means comprising (1) a crane post having a substantially vertical axis, (2) an arm mounted on said post for pivoting movement about said axis, (3) means for supporting the crane post on the cantilever span section beside the module in said stand-by position with said axis spaced equally from the centers of gravity of the module in the stand-by and erection positions and viewing the said centers of gravity at right angle, (4) means in said arm from lifting the module from said stand-by position, (5) means for pivoting the arm by a right angle over said end edge to bring the module to an outboard position above said erection position, and (6) means for lowering the module from said outboard position to said erection position.

5. A system as claimed in claim 4, wherein the means for displacing the module comprise a trolley and means for running the trolley substantially along the centerline of the cantilever span section.

6. A system as claimed in claim 4, wherein the means for supporting the crane post on the cantilever span section comprise a pair of beams extending from a foot portion of the post and respectively in the longitudinal direction and in the transverse direction of the cantilever span section, and the beam which extends in the transverse direction has a height sufficiently low to enable an end portion of the module in the stand-by position to project over the said transverse beam.

7. A system as claimed in claim 6, further comprising members of adjustable height inserted between the beams and the cantilever span section to support the beams thereon.

8. A system as claimed in claim 4, wherein the means for lifting and lowering the module comprise hoisting means supported by the arm, a spreader member, means for hooking the module to the spreader member, and means for supporting the spreader member from the hoisting means, including means for adjusting the spreader member in inclination.

* * * * *